US007249912B2

(12) United States Patent
Reese

(10) Patent No.: US 7,249,912 B2
(45) Date of Patent: Jul. 31, 2007

(54) TEMPORARY PLATFORM OR ROADWAY AND METHOD OF ASSEMBLING SAME

(76) Inventor: Kirby Williams Reese, 9486 Buchanan Trail West, P.O. Box 298, Mercersburg, PA (US) 17236

( * ) Notice: Subject to any disclaimer, the term of this patent is extended or adjusted under 35 U.S.C. 154(b) by 0 days.

(21) Appl. No.: 10/715,240

(22) Filed: Nov. 14, 2003

(65) Prior Publication Data

US 2004/0098817 A1 May 27, 2004

Related U.S. Application Data

(60) Provisional application No. 60/426,475, filed on Nov. 15, 2002.

(51) Int. Cl.
*E01C 9/08* (2006.01)
*E02B 3/00* (2006.01)
*E02B 1/00* (2006.01)

(52) U.S. Cl. ..... 404/36; 404/31; 404/34; 404/35; 405/15; 405/17; 405/19; 405/26

(58) Field of Classification Search ..... 404/34, 404/6, 10, 27, 36, 17, 28, 31, 35; 14/2.6, 14/27; 405/15, 19, 17, 26; 181/210
See application file for complete search history.

(56) References Cited

U.S. PATENT DOCUMENTS 3,607,592 A 9/1971 Jenkins
4,000,923 A * 1/1977 Baldwin ..... 294/81.5
4,086,015 A * 4/1978 Eliasson ..... 404/6
4,197,034 A * 4/1980 Odegaard ..... 405/219
4,376,596 A 3/1983 Green
4,394,924 A * 7/1983 Zaccheroni ..... 220/486
4,483,640 A * 11/1984 Berger et al. ..... 405/15
4,488,833 A 12/1984 Perry et al.
4,643,271 A * 2/1987 Coburn ..... 181/210
4,726,708 A * 2/1988 Papetti ..... 405/19
4,797,026 A * 1/1989 Webster ..... 404/28
5,129,756 A * 7/1992 Wheeler ..... 405/23
5,200,261 A * 4/1993 Taguchi et al. ..... 442/200
5,333,970 A * 8/1994 Heselden ..... 405/286
5,636,938 A * 6/1997 Ragazzo ..... 405/15
5,860,551 A * 1/1999 Knott, Sr. ..... 220/7
5,906,084 A 5/1999 Millington et al.
5,967,694 A 10/1999 Covarrubias et al.
6,048,129 A 4/2000 Rue
6,381,792 B1 * 5/2002 Woodfin ..... 14/2.6
2001/0002968 A1 * 6/2001 Black ..... 405/36

FOREIGN PATENT DOCUMENTS

GB 2221941 A * 2/1990

* cited by examiner

*Primary Examiner*—Raymond W Addie
(74) *Attorney, Agent, or Firm*—Lee Kim; Tucker Arensberg PC

(57) ABSTRACT

A temporary platform or roadway is created using one or a plurality of optionally connected support components to form a top surface upon which panels are placed. The support components are comprised of gabion containers having one or a plurality of compartments into which a filler material is inserted. The filler material can optionally be composed of a buoyant material such as expanded polystyrene to enable flotation. A method for constructing the roadway or platform of the present invention is also disclosed.

20 Claims, 2 Drawing Sheets

TEMPORARY PLATFORM OR ROADWAY AND METHOD OF ASSEMBLING SAME

CROSS REFERENCE TO RELATED APPLICATIONS

The Applicant claims the benefit of the Provisional Patent Application No. 60/426,475, filed on Nov. 15, 2002.

There are no other related applications.

BACKGROUND

1. Field of the Invention

This invention relates to a method and apparatus for creating a temporary roadway or platform in wetlands, marshlands and other soggy and or wet areas. It is often necessary to have access to remote areas that are surrounded by wetlands or some other type of unstable or watery ground conditions. For example, the drilling of oil wells and/or the search for oil fields in remote locations often require the transport of heavy equipment across unstable terrain. Access roads and work platforms must be built. When construction of a permanent road or platform is not cost effective or, in the case of federally protected wetlands, not permitted, a means for providing temporary access to these remote locations that can be easily removed and does not destroy the terrain is desirable.

2. Description of Prior Art

Historically, this temporary access problem has been solved by using fill material to create a temporary road or work platform, stacking repeated layers of wooden mats on top of each other, building elevated road systems on pilings, positioning barges and/or using a pontoon supported road system. Each of these previous solutions is undesirable for one reason or another.

Fill material is often undesirable because it is impossible to remove 100% of the fill that was used for the road. Federal environmental regulations prohibit the use of fill in the wetlands for this reason. Wooden mats, while more easily removed than fill, are expensive to rent or purchase and suffer from the drawback that they are extremely heavy. The excessive weight increases set-up costs and compacts the soft wetlands soil. This soil compaction leaves a watery canal when the mats are removed and alters the habitat.

Depending on the project size, driving pilings deep into the ground to support work platforms and roadways can be prohibitively expensive and impractical. A further complication is that it is possible that one or more of the pilings could penetrate a fresh water aquifer and contaminate the water supply. Barges and tugs suffer from the drawback that they require at least 48 inches of water in order to avoid grounding. For this reason and for the reason that they are unwieldy in small areas, barges and tugs are unsuitable for working in the wetland environment.

Finally, pontoons can be crushed in shallow water and, because they are limited by length, they can not support a heavy concentrated load. Some of the cranes that are used in wetlands construction are approximately 400,000 pounds in weight.

A need, therefore, remains for a method and application that allows construction of a temporary road or platform in wetland or marshland areas that will support the weight of heavy construction equipment, yet will not damage the environment. It is preferable if this method is more cost effective than existing procedures.

SUMMARY OF THE INVENTION

Accordingly, several objects and advantages of my invention are to provide a method and apparatus for enabling transport and support across and over areas of shallow water or unstable terrain.

It is a further object of the present invention to provide a lightweight and easily shipped platform or roadway that can be assembled with minimal environmental impact. The support components of the instant invention result in greatly reduced soil compaction over traditional methods. The disclosed support components are lighter, more buoyant, and less expensive than existing wood mats.

It is still a further object of the present invention to provide platforms and roadways that are capable of supporting extremely heavy loads.

It is also a further object of the present invention to provide a method of constructing the platforms and roadways described herein.

The foregoing objects and advantages are attained by the instant invention. This support component, manufactured using the method set forth in the instant specification, is comprised of a gabion container have one or a plurality of compartments, each such compartment containing a filler material. These new and novel support containers can be connected together to create a top surface upon which panels can be placed to create a platform or roadway.

DESCRIPTION OF THE INVENTION—PREFERRED EMBODIMENT

Figure 1:
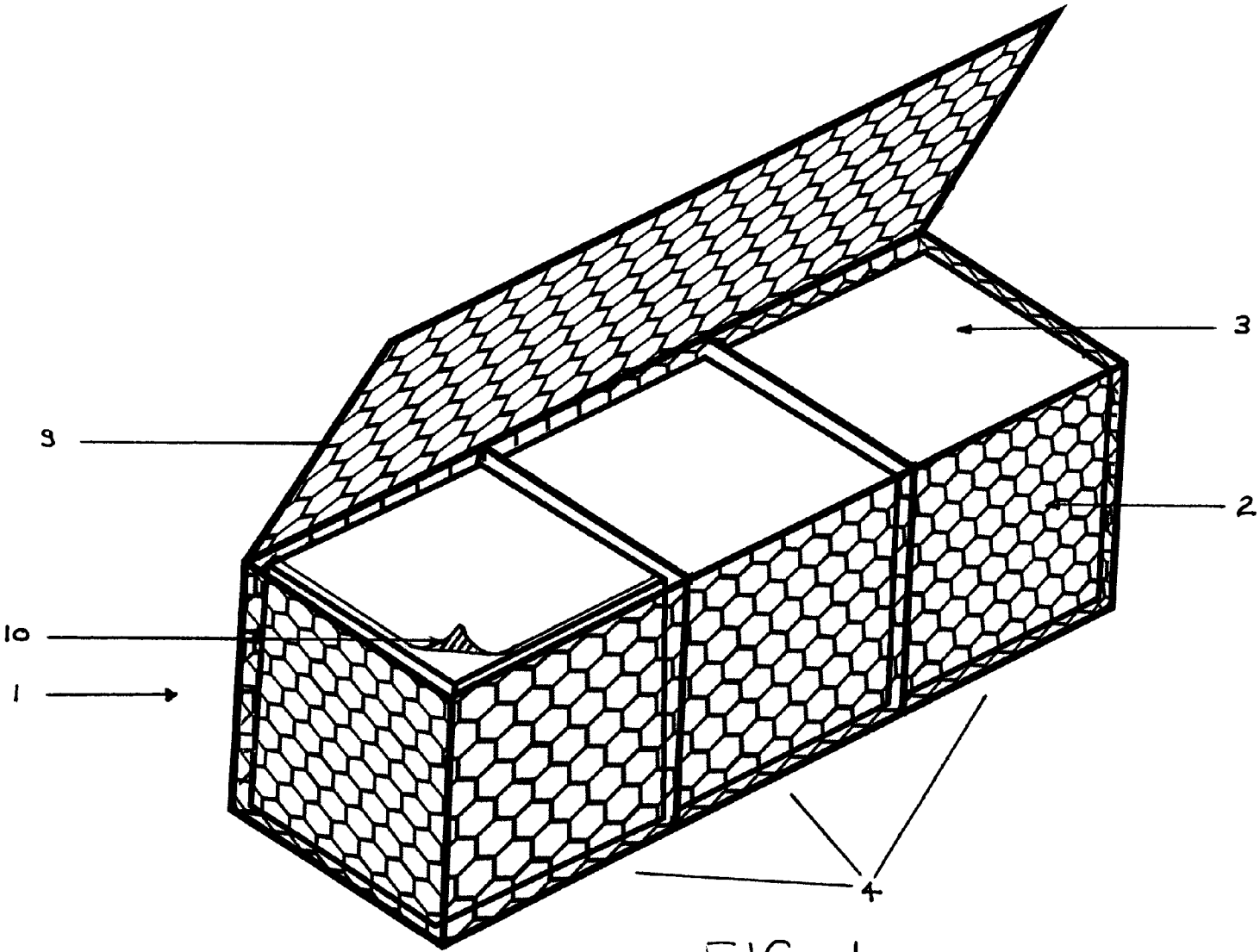
FIG. 1 is an isometric view of the support component of the present invention. The top surface is angled away from the support component to reveal a plurality of compartments containing filler material.

Referring now to the drawings, FIG. 1 illustrates a support component 1 formed in accordance with the present invention. As shown in the figure, the support component 1 comprises a gabion container 2 with a plurality of compartments 4. In a preferred embodiment, the gabion container 2 is composed of polyvinylchloride (pvc) coated wire mesh, although such pvc coating is not necessary to the invention. Further, the gabion container 2 is typically a wire Reno mattress style gabion basket that is approximately three feet wide by twelve feet long by one foot thick.

In each compartment 4, a filler material 3 is optionally fitted to the dimensions of the compartment 4. For example, the filler material 3 in each of the compartments 4 is depicted in FIG. 1 as comprising a single block. The filler material 3 is optionally comprised of a buoyant material such as two-pound density expanded polystyrene (EPS) foam. If buoyancy is not required, the filler material 3 could be made of hay or some other like material. To reduce the possibility of contamination of the environment, the filler material 3 is optionally encapsulated in a wrapper 10 that is preferably composed of a fabric that is a woven geotextile composed of polypropylene yarns such as the FILTERWEAVE® product sold by TC Mirafi, of Pendergrass, Ga. 30567 US, but optionally consists of other like materials capable of containing the filler material 3 in the event, for example, breakage occurs.

The support component 1 is comprised of a gabion container 2 that has a top surface 9 that is shown open in FIG. 1 to expose the compartments 4 and the filler material 3. When the support component is in use, the top surface 9 is closed.

Figure 2:
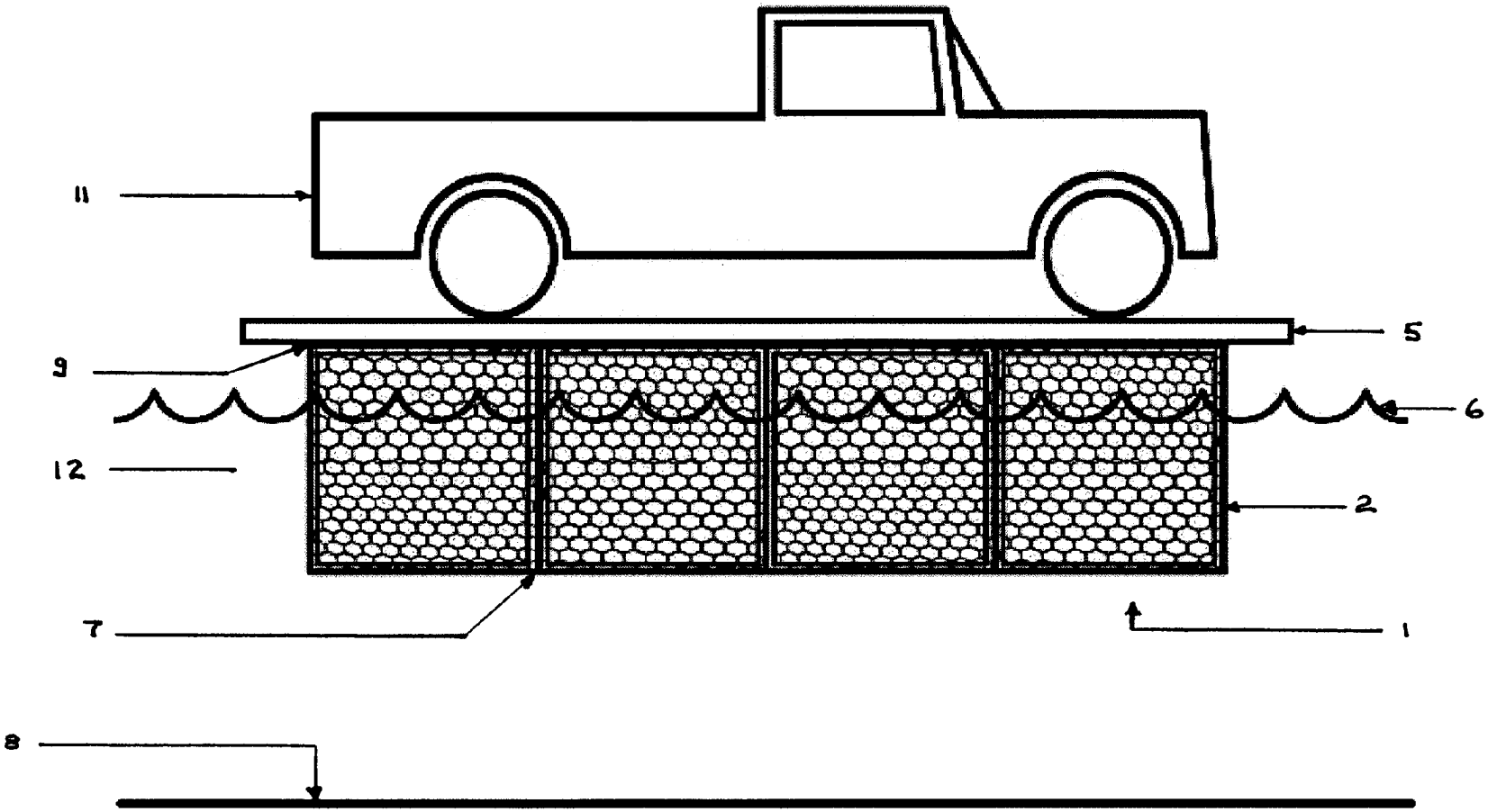
FIG. 2 is a side view of a platform or roadway formed in accordance with the present invention.

Referring now to FIG. 2, a portion of a completed platform or roadway in accordance with the instant invention is shown. In FIG. 2, four support components 1 are connected side by side via a connection mechanism 7 in order to form a large top surface 9. Wires, hooks and factory provided connection mechanisms 9 are used, however, any connection mechanism 9 that keeps the support component from moving relative to one another is sufficient for purposes of the invention. The result is a layer 12 of support components.

Panels 5 are then placed on the top surfaces 9 of the gabion containers 2 to permit equipment 11 placement. In a preferred embodiment, the panels 5 are a wooden interlocking mat system; however, other types of panels 5 will be apparent to those skilled in the art, such as those composed of wood or metal. The water level 6 is shown relative to the terrain 8 to demonstrate the flotation capability of the instant invention, even when equipment 11 is placed on the panels 5. The instant invention will work, however, with the support components 1 resting directly on the terrain 8 instead of floating. In appropriate circumstances, more than one layer 12 can be placed on top of one another to provide more buoyancy or to reach the terrain depending on the need.

In another embodiment, these new support components 1 can easily be connected into multiple surface areas and thicknesses. While the present invention is intended to form temporary platforms and roadways in areas of unstable terrain, other uses are apparent to those skilled in the art. It will be understood that the above description of the present invention is susceptible to various modifications, changes and adaptations, and that the same are intended to be comprehended within the meaning and range of equivalents of the appended claims.

I claim:

1. A portable roadway comprising:

a) a support layer having a wire mesh top surface, wherein said wire mesh top surface defines at least one closed gabion, and said support layer comprises a plurality of wire mesh gabions, each of said wire mesh gabions having a plurality of compartments, each of said compartments being substantially full of a filler material having a density less than that of water; and b) a traffic layer supported by said wire mesh top surface, said traffic layer comprises a plurality of panels placed on said wire mesh top surface, wherein said panels are removable;

wherein said portable roadway has sufficient strength to support construction vehicle traffic.

2. The portable roadway of claim 1, wherein said filler material is expanded polystyrene foam.

3. The portable roadway of claim 1, wherein said filler material is encapsulated in a fabric wrapper.

4. The portable roadway of claim 3, wherein the fabric wrapper is polypropylene yarn.

5. The portable roadway of claim 1, wherein said filler material in at least one of said compartments is in the form of a single block.

6. The portable roadway of claim 1, wherein at least one of said gabions is a mattress gabion.

7. The portable roadway of claim 1, wherein the wire mesh of at least one of said gabions is coated with polyvinylchloride.

8. The portable roadway of claim 1, wherein at least one of said panels is selected from the group consisting of wood panels and metal panels.

9. The portable roadway of claim 1, wherein at least some of said panels are interlockable with each other.

10. A portable platform comprising:

a) a support layer having a wire mesh top surface, wherein said wire mesh top surface defines at least one closed gabion, and said support layer comprises a plurality of wire mesh gabions, each of said wire mesh gabions having a plurality of compartments, each of said compartments being substantially full of a filler material having a density less than that of water; and b) a traffic layer supported by said wire mesh top surface, said traffic layer comprises a plurality of panels placed on said wire mesh top surface, wherein said panels are removable;

wherein said portable platform has sufficient strength to support construction vehicle traffic.

11. The portable platform of claim 10, wherein said filler material is expanded polystyrene foam.

12. The portable platform of claim 10, wherein said filler material is encapsulated in a fabric wrapper.

13. The portable platform of claim 12, wherein the fabric wrapper is polypropylene yarn.

14. The portable platform of claim 10, wherein said filler material in at least one of said compartments is in the form of a single block.

15. The portable platform of claim 10, wherein at least one of said gabions is a mattress gabion.

16. The portable platform of claim 10, wherein the wire mesh of at least one of said gabions is coated with polyvinylchloride.

17. The portable platform of claim 10, wherein at least one of said panels is selected from the group consisting of wood panels and metal panels.

18. The portable platform of claim 10, wherein at least some of said panels are interlockable with each other.

19. A method for constructing a portable roadway or a portable platform comprising the steps of:

a) providing a support layer having a wire mesh top surface, wherein said wire mesh top surface defines at least one closed gabion, and wherein said support layer comprises a plurality of wire mesh gabions, each of said wire mesh gabions having a plurality of compartments, each of said compartments being substantially full of a filler material having a density less than that of water; and, b) providing a traffic layer supported by said wire mesh top surface, said traffic layer comprises a plurality of panels placed on said wire mesh top surface, wherein said panels are removable;

wherein each said portable roadway and each said portable platform have sufficient strength to support construction vehicle traffic.

20. The method of claim 19, further comprising the steps of:

a) providing a fabric wrapper for said filler material;

b) selecting at least a portion of said filler material to be expanded polystyrene foam; and c) encapsulating said expanded polystyrene foam within said fabric wrapper prior to placing said expanded polystyrene foam into one of said compartments.

* * * * *

UNITED STATES PATENT AND TRADEMARK OFFICE

CERTIFICATE OF CORRECTION

PATENT NO. : 7,249,912 B2
APPLICATION NO. : 10/715240
DATED : July 31 2007
INVENTOR(S) : Kirby W. Reese It is certified that error appears in the above-identified patent and that said Letters Patent is hereby corrected as shown below:

Column 2, Line 23, “have” should be changed to --having--.

Column 4, Line 55, “have” should be changed to --has--.

Signed and Sealed this

Sixth Day of November, 2007

JON W. DUDAS
*Director of the United States Patent and Trademark Office*